United States Patent [19]

Anderson

[11] Patent Number: 4,880,126

[45] Date of Patent: Nov. 14, 1989

[54] NESTING PREVENTER FOR BOTTLE BASES

[76] Inventor: Dennis C. Anderson, 6475 Chester Ave., Northfield, Minn. 55057

[21] Appl. No.: 168,244

[22] Filed: Mar. 15, 1988

[51] Int. Cl.[4] ..... B65D 23/00; B65D 23/08

[52] U.S. Cl. ..... 215/100 R; 215/10; 215/121; 206/519; 220/69; 248/346

[58] Field of Search ..... 215/100 R, 1 C, 12.1, 215/10, 2; 206/519; 220/69; 248/346, 346.1; 229/1.5 B

[56] References Cited

U.S. PATENT DOCUMENTS

| | | | |
|---|---|---|---|
| 3,441,173 | 4/1969 | Edwards | 229/1.5 B X |
| 3,927,782 | 12/1975 | Edwards | 215/100 R |
| 4,241,839 | 12/1980 | Alberghini | 215/100 R |
| 4,436,216 | 3/1984 | Chang | 220/69 |
| 4,438,856 | 3/1984 | Chang | 215/100 R X |
| 4,746,017 | 5/1988 | Howard et al. | 215/2 X |

*Primary Examiner*—Sue A. Weaver
*Attorney, Agent, or Firm*—James V. Harmon

[57] ABSTRACT

A cup-shaped bottle base is provided with four upright, circumferentially spaced apart centrally projecting flanges that have downwardly and centrally inclined upper edges which act as ramps or skids to prevent the lower end of a similar base from becoming jammed inside it.

5 Claims, 1 Drawing Sheet

NESTING PREVENTER FOR BOTTLE BASES

FIELD OF THE INVENTION

This invention relates to bottoms or bases of bottles such as soda pop bottles which serve as a stand for the bottle and more particularly to an improved means for preventing nesting of such bottle bases.

BACKGROUND OF THE INVENTION

The bases of soda pop bottles sometimes become nested within one another during shipment or storage and when fed to the assembly equipment that is used for attaching them to the bottle, the nested bases occasionally jam the equipment. To prevent this, projections have been provided on the outside of the bottle base. These projections not only mar the appearance of the otherwise smooth surface but in addition, the upper edge of one bottle base can become stretched over the projections, allowing them to become wedged in place even more strongly than if the projections were not used.

To overcome these deficiencies of the prior art the present invention provides an improved nesting preventer for the base of a bottle which comprises a plurality of fin-like projections that project centrally from the side wall of the bottle bottom. Each includes a downwardly and centrally inclined upper edge that extends from the side wall downwardly at an acute angle. When another bottle bottom or base is inadvertently pushed into the interior of such a base, the upper edge of the projection acts as a deflection ramp which prevents the base on top from entering the one below it. The engagement between the upper edge of the nesting preventer serves as a ramp or skid causing the base that is entering from above to tilt to one side or the other, but it surprisingly will not jam in place. At the same time, however, the bottom of the bottle will fit nicely into the base so that the mounting of the base on the bottom of the bottle is not in any way interfered with.

The invention will be better understood by reference to the figures which illustrate by way of example but a few of the various ways in which the present invention can be accomplished within the scope of the appended claims.

THE FIGURES

DESCRIPTION OF A PREFERRED EMBODIMENT

Figure 1:
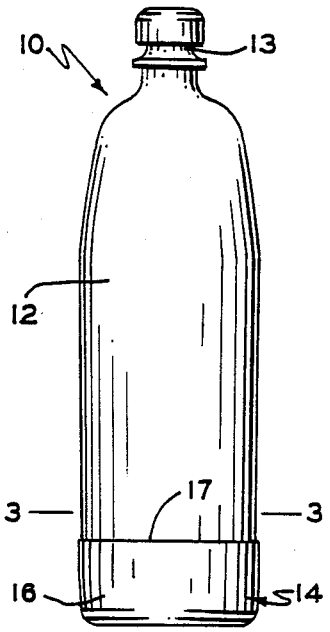
FIG. 1 is a side elevational view of a soda pop bottle having a base embodying the present invention.

Shown in FIG. 1 is a thin-walled lightweight plastic bottle 10 of the type often used for soda pop. It includes a side wall 12, a mouth at the top of the neck 13, and a base 14 which is generally cup-shaped in configuration for the purpose of holding the bottle upright and for protecting the bottom portion during shipment and storage.

Figure 3:
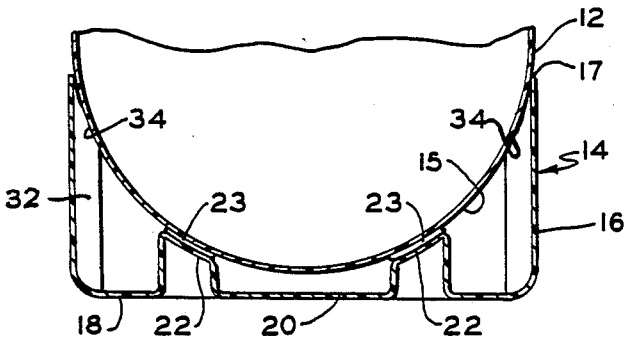
FIG. 3 is a partial vertical sectional view on line 3—3 of FIG. 1 on a larger scale.

As can be seen in FIG. 3, the bottom portion of the bottle 10 indicated at 15 is generally hemispherical in shape and thus will not stand up without the base 14.

The base 14 includes a vertically disposed, generally cylindrical side wall 16 terminating in an upper horizontally disposed open wide mouth or upper edge 17. The base 14 also includes a horizontal bottom wall 18 with a central portion 20 separated from the outer edge portion of the bottom wall 18 by an upwardly deflected bottom mounting ring 22 to which the bottom 15 of the bottle 10 is secured by means of an adhesive 23. The base thus far described is similar to the bases now in commercial use. When the base 14 is to be applied to the bottle 10 the adhesive 23 is applied to the mounting ring 22 by means of automatic equipment and the bottle 10 is then lowered into the base until the bottom surface 15 strikes the adhesive 23, thereby securely bonding the base 14 to the bottom of the bottle 10.

Figure 2:
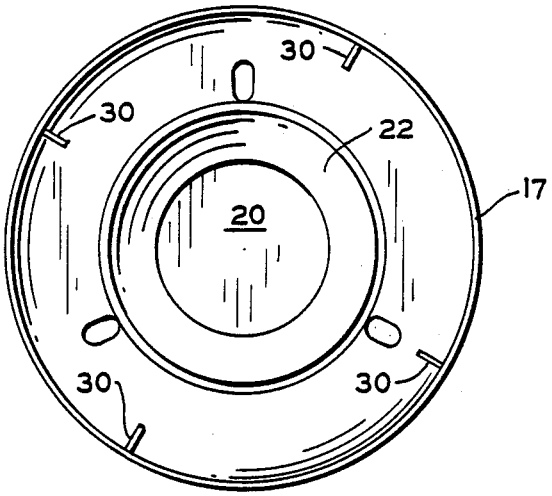
FIG. 2 is a top view of the base on an enlarged scale.
Figure 4:
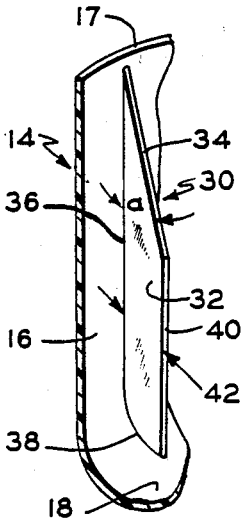
FIG. 4 is a partial perspective view of the inside of the base.

In accordance with the present invention, in order to prevent the bases 14 from stacking one inside the other prior to the assembly operation described above, a plurality and preferably at least three stacking inhibitors 30 are provided. The stacking inhibitors 32 comprise flanges conveniently formed from plastic resinous material integral with the side wall 16 of the base 14 and having a vertically disposed outer edge 36 which curves downwardly and centrally at 38 along the bottom surface 18 of the base 14 and an inner edge 40 which in FIGS. 2–4 is parallel with the outer edge 36. The width of the nesting preventer 30 can be quite narrow, say on the order of the same thickness as the side wall 16 of the base 14, e.g. about 1/16th of an inch or less, but can be wider if desired. As shown in the figures the nesting preventer 32 includes a downwardly and centrally inclined upper wall 34 which functions as a ramp or skid surface to engage the lower portion of a similar base and thereby prevent it from becoming nested therewithin. The upper edge 34 is thus inclined downwardly and centrally at an acute angle ($\alpha$) of about 30°. Thus, the upper edge 34 which functions as a ramp or skid was found to be highly effective in preventing the bases from nesting or jamming inside one another. It was found that the bases do not tend to nest inside one another in the first place but even if a substantial amount of pressure is applied, as might result when a large corrugated carton containing the bases is forced shut, the pressure will still not cause the bases to jam one inside the other. While the precise reason for this is not known with certainty, it is believed that the acute angle ($\alpha$) of the ramp surface 34 and its slipperiness causes the base to spring back out again even if the side wall 16 is stretched when the one base is forced into the other. As clearly shown in FIG. 3, the nesting preventer 30 will not interfere with the placement of the lower surface 15 of the bottle 10 within the base 14. While the width 42 (FIG. 4) of the stacking preventer 32 can be varied to suit different size bottles, a width 42 of about ¼ inch has been found suitable for many applications. The acute angle ($\alpha$) can also be varied depending upon the size and construction of the base 14 and the bottle 10. Typically, however, for most purposes the angle ($\alpha$) is between about 10° and 40°.

Figure 5:
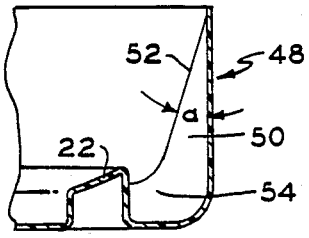
FIG. 5 PRIOR ART
FIG. 5 is a partial vertical sectional view of another form of base in accordance with the invention.

Refer now to FIG. 5 which illustrates a modified form of the invention. In FIG. 5 is shown a base 48 similar to the base 14 and including a mounting ring 22 like that of FIGS. 1–4 except that the nesting inhibitor 50 has an upper free edge that is inclined downwardly and centrally at an acute angle ($\alpha$) but which in this case extends centrally as does the nesting preventer 50 itself, all the way to the mounting ring 22. In this way the nesting preventer 50 is provided with a central portion 54 which is integral with the mounting ring 22 at its inner edge. The acute angle ($\alpha$) between the upper free edge 52 of the nesting preventer 50 is the same as already described above in connection with FIGS. 1–4. While the nesting preventer 50 of FIG. 5 is somewhat stronger in construction, the extension 54 is not necessary for most applications and can be eliminated in most cases, thereby saving resin costs as in the construction of FIGS. 1–4.

Figure 6:
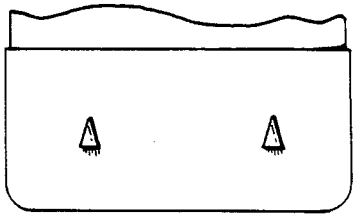
FIG. 6 is a side elevational view of a base in accordance with the prior art.

In FIG. 6 which illustrates the prior art it will be seen that the bottle base is provided with a pair of external generally cone-shaped spaced apart projections which are intended to engage the top of a similar base in the event they become nested to prevent them from becoming stuck inside one another. In practice, however, it has been found that the projections sometimes slip inside the upper edge of an adjacent base, causing one base to become jammed inside another. With the present invention this is impossible.

Many variations of the present invention within the scope of the appended claims will be apparent to those skilled in the art once the principles described above are understood.

What is claimed is:

1. A bottle base for a soda pop bottle or the like comprising, a base formed from plastic resinous material having a cylindrical side wall terminating in an upper open wide mouth defining a rim and an integral bottom wall extending horizontally across the lower aspect of the base, mounting means within the base for the attachment of a bottom portion of the bottle to the inside of the base and a plurality of internally projecting stacking preventers extending substantially the full height of the base, terminating at the rim, said stacking preventers projecting centrally from the side wall and being spaced apart from one another in a circle which has the same diameter as the cylindrical side wall and each of said stacking preventers including a downwardly inclined centrally directed upper free edge intersecting with said side wall at an acute angle that comes to a point proximate to the open mouth to define a ramp surface which extends downwardly from the mouth and centrally to engage the bottom of a similar base to prevent it from entering the mouth a sufficient distance to become stacked or nested within the base.

2. The bottle base of claim 1 wherein the acute angle ($\alpha$) between the upper edge of the stacking preventer and the side wall of the base is on the order of about 10° to about 40°.

3. The bottle base of claim 1 wherein the stacking preventer has a vertically disposed outer edge integral with said side wall of the base, a vertically disposed central edge parallel to the outer edge and spaced a fraction of an inch therefrom to define a vertically disposed flange having parallel inner and outer edges and an inclined upper edge defining said ramp surface.

4. The bottle base of claim 1 wherein the inclined upper edge extends downwardly and projects centrally toward said mounting means and said stacking preventer has a central portion integral with the mounting means for the bottle.

5. The bottle base of claim 1 wherein two pairs of said stacking preventers are provided within the base spaced apart from one another circumferentially.

* * * * *